US008407970B2

(12) United States Patent
Rometty et al.

(10) Patent No.: US 8,407,970 B2
(45) Date of Patent: Apr. 2, 2013

(54) APPARATUS AND METHOD FOR PACKAGING A LOAD HAVING PROJECTIONS

(75) Inventors: John A. Rometty, Barrington, IL (US); Nancy L. Roach, Cincinnati, OH (US); Jeffrey W. O'Hara, Cherry Valley, IL (US)

(73) Assignee: Illinois Tool Works Inc., Glenview, IL (US)

( * ) Notice: Subject to any disclaimer, the term of this patent is extended or adjusted under 35 U.S.C. 154(b) by 323 days.

(21) Appl. No.: 12/404,054

(22) Filed: Mar. 13, 2009

(65) Prior Publication Data

US 2009/0260328 A1 Oct. 22, 2009

Related U.S. Application Data

(60) Provisional application No. 61/046,106, filed on Apr. 18, 2008.

(51) Int. Cl.
*B65B 3/04* (2006.01)
*B65D 81/113* (2006.01)
*B65D 85/62* (2006.01)

(52) U.S. Cl. ..... 53/474; 53/255; 53/263; 206/325; 206/514; 206/586

(58) Field of Classification Search ..... 53/474, 53/263, 255, 241; 206/453, 521, 583, 586, 206/588, 590, 585, 514, 325, 591, 592
See application file for complete search history.

(56) References Cited

U.S. PATENT DOCUMENTS 1,561,210 A * 11/1925 Booraem ..... 414/800
1,783,570 A * 12/1930 Hill ..... 206/591
2,410,591 A * 11/1946 Turner ..... 206/586
2,578,107 A * 12/1951 Thacker et al. ..... 206/703
2,946,498 A * 7/1960 Williamson ..... 206/419
3,017,022 A * 1/1962 Amundson ..... 206/325
3,131,656 A * 5/1964 Houle ..... 108/51.3
3,133,687 A * 5/1964 Fremion ..... 206/454
3,335,932 A * 8/1967 Brown ..... 206/453
3,338,501 A * 8/1967 Clay ..... 206/521
3,343,662 A * 9/1967 Bendoff ..... 206/499
3,469,542 A * 9/1969 Ahlenius ..... 108/56.1
3,497,057 A * 2/1970 Traner et al. ..... 206/730
3,564,811 A * 2/1971 Freeman ..... 53/474
3,651,934 A * 3/1972 Roberts et al. ..... 206/326
3,871,521 A * 3/1975 Szatkowski ..... 206/524
3,928,953 A * 12/1975 Mazzoni et al. ..... 52/172
3,955,744 A * 5/1976 Casutt ..... 206/521.1
4,050,604 A * 9/1977 Flanders ..... 220/4.28
4,130,615 A * 12/1978 Decker et al. ..... 264/46.5
4,148,396 A * 4/1979 Gardner ..... 206/521
4,170,297 A * 10/1979 Johnson ..... 206/326
4,182,450 A * 1/1980 Kryger ..... 206/448
4,305,508 A * 12/1981 Rodgers ..... 211/85.8
4,317,517 A * 3/1982 Tisdale ..... 206/597

(Continued)

*Primary Examiner* — M. Alexandra Elve
*Assistant Examiner* — Gloria R Weeks
(74) *Attorney, Agent, or Firm* — Levenfeld Pearlstein, LLC

(57) ABSTRACT

A packaging container for a load having a projection such as a nailing fin is made from two rigid U-boards. An inner U-board supports the weight of the window/door frame while preventing the nailing fin from having contact, directly or indirectly, with the ground or sides of the fin crate. The nailing fin provides one supporting wall for the inner U-board while a second, outer U-board provides a second supporting wall. Both walls prevent the inner U-board from spreading out or collapsing under the weight of the window/door. The inner U-board is formed as a continuous element or as discrete elements. The nailing fin is incorporated into the fin crate to form a support member and part of the packaging container.

9 Claims, 2 Drawing Sheets

U.S. PATENT DOCUMENTS 4,343,135 A * 8/1982 Ilich ..... 53/444
4,382,733 A * 5/1983 Rodgers ..... 410/49
4,429,791 A * 2/1984 Ruppel et al. ..... 206/454
4,584,822 A * 4/1986 Fielding et al. ..... 53/452
4,805,774 A * 2/1989 Salisbury ..... 206/454
4,884,687 A * 12/1989 Steves ..... 206/321
4,915,247 A * 4/1990 Odenthal ..... 206/453
4,967,905 A * 11/1990 Steves ..... 206/321
4,972,954 A * 11/1990 Dickie ..... 206/523
4,976,374 A * 12/1990 Macaluso ..... 229/122.26
4,979,446 A * 12/1990 Winebarger ..... 108/51.3
5,058,745 A * 10/1991 Warner et al. ..... 206/523
5,058,746 A * 10/1991 Morgan, IV ..... 206/597
5,101,976 A * 4/1992 Salisbury ..... 206/454
5,218,913 A * 6/1993 Winebarger et al. ..... 108/51.3
5,320,225 A * 6/1994 Kirkpatrick ..... 206/449
5,322,168 A * 6/1994 Kataoka ..... 206/588
5,323,905 A * 6/1994 Gerondale et al. ..... 206/461
5,325,967 A * 7/1994 Gonzales ..... 206/462
5,328,033 A * 7/1994 Ptaschinski ..... 206/586
5,392,920 A * 2/1995 Prete ..... 206/586
5,427,034 A * 6/1995 Kilpatrick et al. ..... 108/51.3
5,490,465 A * 2/1996 Hoyt et al. ..... 108/51.3
5,503,085 A * 4/1996 Rozek ..... 108/51.3
5,509,534 A * 4/1996 Taravella et al. ..... 206/587
D396,008 S * 7/1998 Hay ..... D9/455
5,947,290 A * 9/1999 Loeschen ..... 206/453
5,979,659 A * 11/1999 Kataoka ..... 206/588
6,029,410 A * 2/2000 Westberg et al. ..... 52/204.1
6,059,181 A * 5/2000 Marbry et al. ..... 229/120.36
6,199,700 B1 * 3/2001 Yamamoto et al. ..... 206/586
6,257,412 B1 * 7/2001 Yamamoto et al. ..... 206/586
6,276,526 B1 * 8/2001 Miller et al. ..... 206/321
6,332,535 B1 * 12/2001 Usui et al. ..... 206/386
6,357,587 B1 * 3/2002 Melms, Jr. ..... 206/326
6,675,970 B1 * 1/2004 Nemoto ..... 206/521
6,685,026 B1 * 2/2004 Hanna ..... 206/586
6,794,018 B2 * 9/2004 Clark ..... 428/188
6,926,947 B1 * 8/2005 Seckel ..... 428/174
7,296,680 B2 * 11/2007 Yokawa ..... 206/521
7,434,682 B2 * 10/2008 Valenzano et al. ..... 206/215
7,458,465 B1 * 12/2008 Dahl et al. ..... 206/592
7,748,527 B2 * 7/2010 Wisecarver et al. ..... 206/321
7,748,539 B2 * 7/2010 Onda et al. ..... 206/591
7,753,208 B2 * 7/2010 Schneider et al. ..... 206/523
8,127,928 B2 * 3/2012 Stack et al. ..... 206/583
2007/0157558 A1 * 7/2007 Mertz et al. ..... 53/399
2007/0215495 A1 * 9/2007 O'Hara et al. ..... 206/141
2009/0057380 A1 3/2009 Rometty et al.
2009/0057383 A1 * 3/2009 Rometty et al. ..... 229/117.16
2012/0103854 A1 * 5/2012 Ooi et al. ..... 206/521
2012/0187025 A1 * 7/2012 Bowman ..... 206/756

* cited by examiner

APPARATUS AND METHOD FOR PACKAGING A LOAD HAVING PROJECTIONS

CROSS-REFERENCE TO RELATED APPLICATION

This application claims the benefit of priority of Provisional U.S. Patent Application Ser. No. 61/046,106, filed Apr. 18, 2008, entitled "APPARATUS AND METHOD FOR PACKAGING NAILING FINS".

BACKGROUND OF THE INVENTION

The present invention is directed to a packaging container. More particularly, the present invention pertains to a packaging container and as method for packaging a load, such as a window or a door, having one or more projections such as nailing fins.

Windows and doors are installed into homes and businesses in a variety of ways. One method includes providing a nailing fin to the outer perimeter of one or more of the sides of the window or door frame. A nailing fin is a flange-type element attached to the outer perimeter of the frame of the window or door, generally in the same plane as the glass or glazing, and commonly made of lightweight, relatively thin material such as vinyl or aluminum. Nailing fins are fastened to the wall(s) adjacent to the opening for the window or door in order to secure the window or door within the opening. Window and door products typically include nailing fins formed either as an integral part of the frame or as separate "add-on" fins.

The window and door industry has looked for many years for a way to package windows and doors that have the nailing fin integral with the supporting window or door frame so as not to damage the nailing fin; however, packaging of the windows and doors having nailing fins is challenging. It is difficult to ship the frame from the factory to the building site due to the increased height and width of the window or door due to the fin. In addition, the nailing fin is easily damaged and often needs to be supported within the packaging or provided with special blocking or protection in order for it to be transported and delivered.

Current methods of blocking the nailing fin inside packaging containers includes using solid blocks of wood or hollow tubes of vinyl. While wooden blocks such as two-by-fours or one-by-twos work relatively well, the wood, whether solid or hollow, add considerable expense to and increase the weight of the package substantially. Another method of packaging nail-finned windows and doors uses hollow vinyl tubes to support the nailing fin in the package. This method, however, is also expensive and additionally, is environmentally unfriendly. In both cases, the customer has to find a way to dispose of the wood blocks and vinyl. If the project is a new construction or large remodeling project with many window and door installations, the amount of wood blocks or vinyl tubing material needed to be discarded is potentially enormous. Furthermore, the cost and fees associated with disposing of these items is likewise large.

Accordingly, there is a need for a packaging container and a method for packaging that minimizes damage to projections on loads without compromising the integrity or strength of the packaging container. The packaging container would, desirably, be inexpensive to manufacture and use, and most desirably environmentally friendly.

BRIEF DESCRIPTION OF THE SEVERAL VIEWS OF THE DRAWINGS

The benefits and advantages of the present invention will become more readily apparent to those of ordinary skill in the relevant art after reviewing the following detailed description and accompanying drawings, wherein.

DETAILED DESCRIPTION OF THE INVENTION

Figure 1:
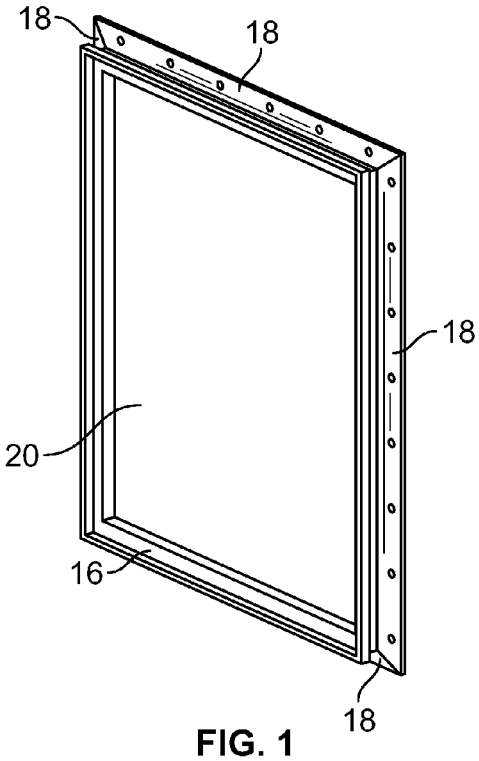
FIG. 1 is a front view of a load having a projection along its edges, such as a window, having a nailing fin surrounding the perimeter of the window frame.

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiment illustrated.

It should be further understood that the title of this section of this specification, namely, "Detailed Description Of The Invention", relates to a requirement of the United States Patent Office, and does not imply, nor should be inferred to limit the subject matter disclosed herein.

A packaging container, also referred to as a fin crate for packaging a load having nailing fins includes two recyclable laminated formations, such as two U-boards. A U-board is commonly formed by a lamination of paper, paperboard, chipboard or the like that is formed in a rigid U-shape. An extra-strength U-board is disclosed in Rometty, U.S. patent application Ser. No. 11/845,257, filed Aug. 27, 2007; a heavy duty handle U-board is disclosed in U.S. Ser. No. 11/845,381, filed Aug. 27, 2007; and a rigid U-shaped packaging container with integral handle is disclosed in U.S. Patent Publication Number 2007/0215495, filed Mar. 17, 2006, all commonly assigned with the present application and incorporated herein by reference. It will be appreciated that while the present application uses as an example a window or door having a nailing fin, any type of load having a projection along an edge of the load may be packaged with the presently claimed invention.

An inner U-board is inverted and interlaced with an outer U-board. The inner U-board supports the weight of the load frame while preventing the nailing fin of the load from directly or indirectly contacting the ground or sides of the fin crate. The nailing fin, when the load is placed in the fin crate, provides one supporting wall for the inner U-board while the outer U-board provides an outer supporting wall for the inner U-board. Both the nailing fin and the outer wall of the outer U-board prevent the inner U-board from spreading out or collapsing under the weight of the window/door. The inner U-board may be one continuous piece or may be several individual, non-contiguous pieces throughout the fin crate. By incorporating the nailing fin into the fin crate as a supporting piece, the load with the nailing fin becomes an integral part of the packaging. The utilization of the nailing fin increases the strength and stability of the crate.

Referring now to the figures, there is shown in FIG. 1 a window 20 having a frame 16 and a perimeter nailing fin 18. While the present disclosure shows an exemplary window having a nailing fin, it is understood that the present invention can be used with other loads or products, such as doors, that have projections that need support and protection in packaging. The nailing fin 18 of FIG. 1 is shown to run the perimeter of the window 20; however, it is also common to have nailing fins 18 located on only the top and bottom of the window 20 or only on the sides of the window.

Figure 2:
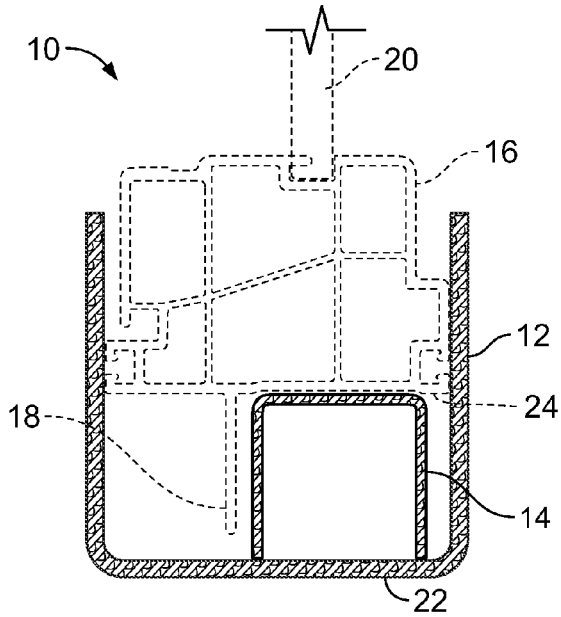
FIG. 2 is a cross-sectional view of an embodiment of a packaging container in accordance with the principles of the present invention, the container supporting a load, such as a window, having a projection.
Figure 3:
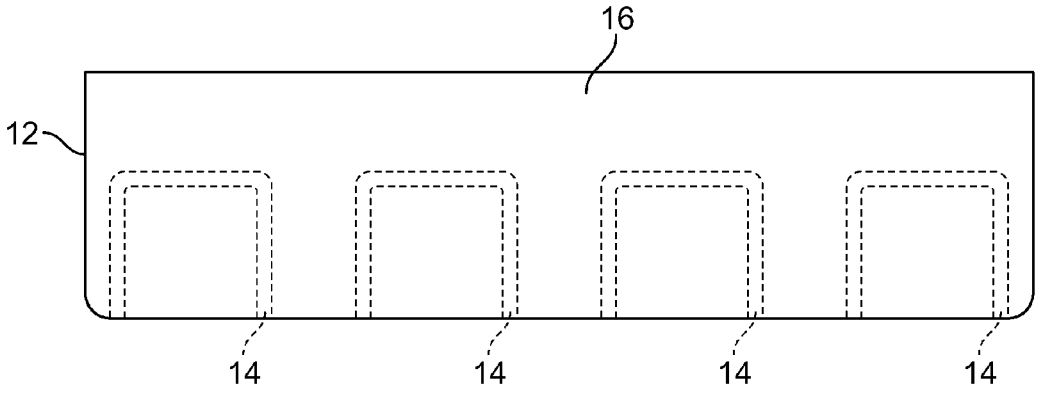
FIG. 3 is a side view of the packaging container supporting the load.

Referring now to FIG. 2, a load, such as a window 20 having a frame 16 and a nailing fin 18 is shown in cross-section. The frame 16 of the window 20 is positioned within the fin crate 10. An smaller, inner U-board 14 is inverted and interlaced with a larger outer U-board 12. In one embodiment, one inner U-board extends an entire length of the outer U-board. In an alternate embodiment, multiple, shorter U-boards may be used. FIG. 3 illustrates a fin crate having a plurality of inner, non-continuous, U-boards 14 interspersed throughout the length of the outer U-board 12.

Figure 4:
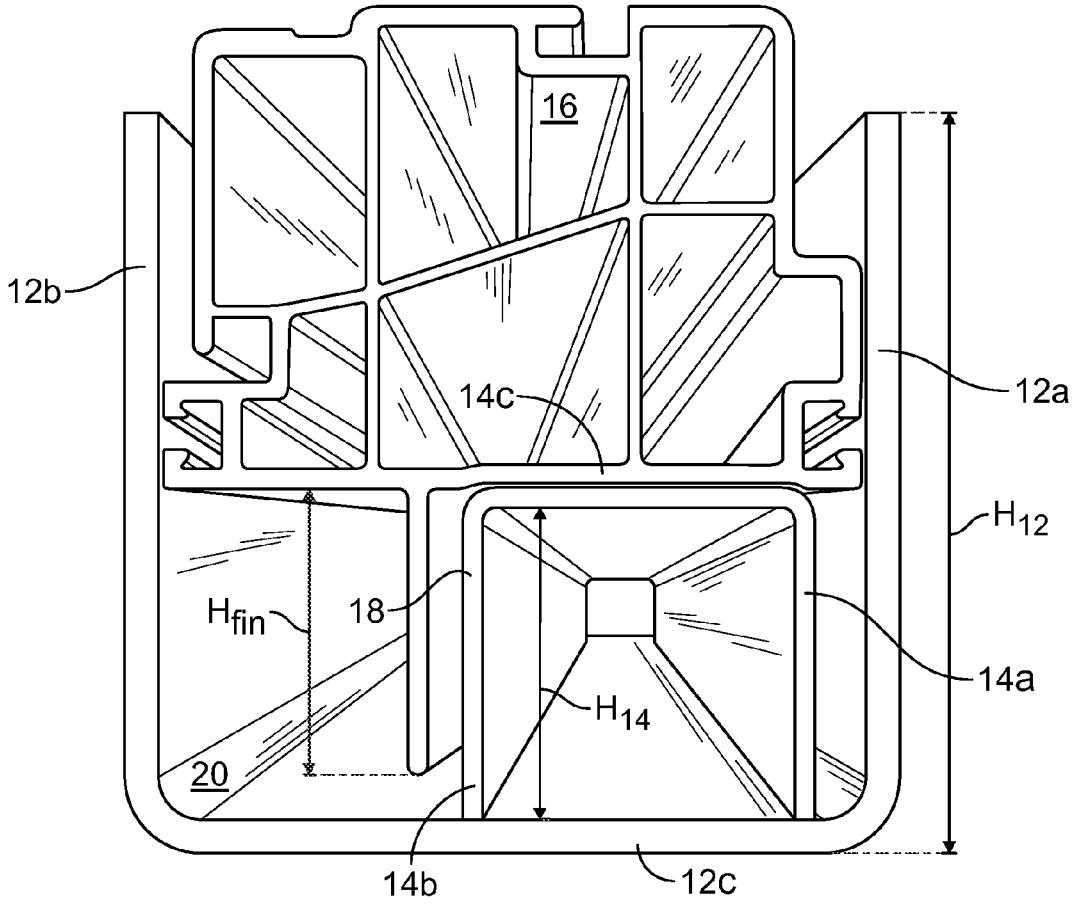
FIG. 4 is an illustration of the side view of the container supporting the load.

As shown in FIG. 4, inner U-board 14 has an outer side wall 14*a*, inner side wall 14*b*, and a first surface 14*c*. Outer U-board 12 has an outer wall 12*a*, an inner wall 12*b*, and a first surface 12*c*. The outer U-board outer wall 12*a* braces inner U-board outer wall 14*a*. One or both of the inner U-board's walls 14*a* and 14*b* touch or are in contact with the first surface 12*c* of the outer U-board. The height of the outer U-board $H_{12}$, is equal to or greater than the height of the inner U-board, $H_{14}$. Similarly, the height of the nailing fin, $H_{fin}$ is less than a height of the height of the inner U-board.

The base 24 of the frame 16 rests on and is supported by the first surface 14*c* of inner U-board 14. The weight of the frame 16, therefore, is supported by the inner U-board 14. Two walls prevent the inner U-board 14 from buckling, bowing, or spreading out under the weight of the frame 16. As discussed above, outer U-board outer wall 12*a* supports inner U-board outer wall 14*a*.

In addition, the inner U-board's inner wall 14*b* is supported by the nailing fin 18 itself. When the base 24 of the frame 16 is positioned on the inner U-board 14, and in particular on inner U-board first surface 14*c*, the nailing fin 18 is positioned along a lateral portion of the inner U-board 14, alongside inner U-board inner wall 14*b*. Positioning the nailing fin 18 lateral to the inner U-board wall 14*b* serves to form a brace for inner U-board wall 14*b*. Thus, the nailing fin 18 becomes an integral part of the fin crate 10. In addition, because the height of the fin $H_{fin}$ is less than the height of the inner U-board $H_{14}$, an air gap 20 is formed around the nailing fin 18 such that the nailing fin is prevented from coming in contact, directly or indirectly, with the ground or the first surface 12*c* of the outer U-board 12. The nailing fin 18 both is supported by the fin crate 10 and acts as a support to the fin crate 10. The outer U-board wall 12*b* provides added protection to the outside of the window or door, as does wall 12*a*.

Figure 5:
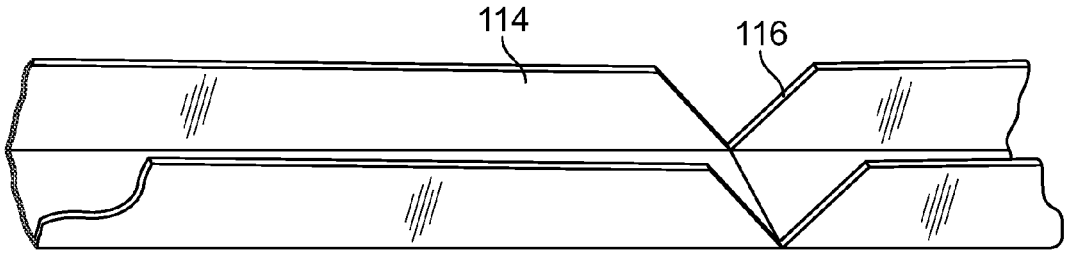
FIG. 5 illustrates an alternate embodiment of the U-board having mitered edges.

An alternate embodiment of the U-board having mitered sides 116 is shown in FIG. 5. Mitering the inner U-board 114 allows a section of inner U-board 114 to be molded around the corner of the window or door, the area most vulnerable on the window frame. Similarly, the outer U-board would be correspondingly mitered (not shown) to provide a fin crate which can be molded or folded around edges of a load.

The fin crate 10 can be sized to fit any door or window fin. In addition, using two U-boards 12, 14 allows the fin crate 10 to be recyclable, making disposal of the fin crate 10 easy and inexpensive. Furthermore, the fin crate 10 is extremely durable and strong. Tests have shown that a one (1) foot (12 inch) section of the U-board at 0.120 caliper can support over 250 pounds of weight. Therefore, it is not necessary to have one continuous inner U-board 14 to support the frame 16 and nailing fin 18 in the fin crate 10. Noncontiguous sections of inner U-board 14, as shown in FIG. 3, are sufficient to effectively and efficiently support the frame 16, making the fin crate far less expensive than some current methods of packaging windows and doors with fins. A wood block or vinyl capable of carrying the same amount of load produces an overall packaging that is heavier, as well as more expensive and more difficult to discard when the package is unwrapped. Thus, the use of two U-boards produces a significant cost savings over other items used to package and support nailing fins, as well as reduces the overall weight of the fin crate.

All patents referred to herein, are incorporated herein by reference, whether or not specifically done so within the text of this disclosure.

In the present disclosure, the words "a" or "an" are to be taken to include both the singular and the plural. Conversely, any reference to plural items shall, where appropriate, include the singular.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

What is claimed is:

1. A method for packaging a load having a projection comprising:

providing a load having projections, the projections having a first surface and a second surface;

interlacing an inverted inner U-board with an outer U-board, the inner U-board being separate and distinct from the outer U-board, wherein the inner U-board has a first surface, an inner wall, and an outer wall, wherein the outer U-board has a first surface, an inner wall, and an outer wall, the first surface of the inner U-board being substantially parallel to the first surface of the outer U-board, the inner and outer U-boards being substantially parallel to one another, each of the inner and outer U-boards having a height, the height of the outer U-board being sufficiently greater than the height of the inner U-board to accommodate the projection therebetween, wherein a space is defined between the inner wall of the inner U-board and the inner wall of the outer U-board and wherein the first surface of the inner U-board is configured to support the load projection and the inner wall of the inner U-board is configured to protect the projection by supporting the first surface of the projection.

2. The method for packaging of claim 1, wherein the inner U-board is a continuous U-board.

3. The method for packaging of claim 1, wherein the inner U-board is a plurality of discrete, non-contiguous U-boards.

4. The method for packaging of claim 1, wherein interlacing the inner U-board and the outer U-board form an air gap.

5. A packaging container for a load having a projection comprising:

an inner U-board, the inner U-board having a first surface, an outer side wall, and an inner side wall; and an outer U-board, the outer U-board being separate and distinct from the inner U-board, the outer U-board having a first surface and an inner wall, wherein the inner U-board rests within, and is substantially parallel to, the outer U-board, the inner U-board inverted and interlaced with the outer U-board, the first surface of the inner U-board being substantially parallel to the first surface of the outer U-board, the inner and outer U-boards each having a height, the height of the outer U-board being sufficiently greater than the height of the inner U-board to accommodate the projection therebetween, wherein the inner U-board is configured to support the load projection on the first surface of the inner U-board and provide an air gap between the projection and the first surface of the outer U-board, and wherein a space is defined between the inner U-board inner side wall and the inner wall of the outer U-board.

6. The packaging container of claim 5, wherein the inner U-board is a continuous U-board.

7. The packaging container of claim 5, wherein the inner U-board is a plurality of discrete, non-contiguous U-boards.

8. The packaging container of claim 5, wherein the packaging is made from a recyclable material.

9. The packaging of claim 1 wherein a one (1) foot long section of the inner U-board having a thickness of about 0.120 caliper is configured to support a weight of the load of at least 250 pounds.

* * * * *